United States Patent [19]

Fleury

[11] Patent Number: 4,860,418

[45] Date of Patent: Aug. 29, 1989

[54] METHOD OF ASSEMBLING A ROTOR OF A STEAM TURBINE CONSTITUTED BY DISKS SHRUNK ONTO A SHAFT

[75] Inventor: Daniel Fleury, Nanteui Le Haudouin, France

[73] Assignee: Societe Anonyme dite: ALSTHOM, Paris, France

[21] Appl. No.: 194,253

[22] Filed: May 16, 1988

[30] Foreign Application Priority Data

May 14, 1987 [FR] France ..... 87 06784

[51] Int. Cl.[4] ..... B21K 3/00

[52] U.S. Cl. ..... 29/156.8 R; 29/418

[58] Field of Search ..... 29/156.8 R, 418, 447, 29/464; 403/273

[56] References Cited

U.S. PATENT DOCUMENTS

| | | | |
|---|---|---|---|
| 2,179,556 | 11/1939 | Lysholm | 29/156.8 R |
| 2,639,119 | 5/1953 | Greenwald | 29/156.8 R |
| 2,800,706 | 7/1957 | Lindblom | 29/156.8 R |
| 3,745,628 | 7/1973 | Stahl | 29/156.8 R |
| 4,494,287 | 1/1985 | Cruzen et al. | 29/418 |
| 4,632,634 | 12/1986 | Vinciguerra et al. | 29/156.8 R |

FOREIGN PATENT DOCUMENTS

| | | | |
|---|---|---|---|
| 2193125 | 2/1988 | United Kingdom | 29/156.8 R |

*Primary Examiner*—Howard N. Goldberg
*Assistant Examiner*—Irene Cuda
*Attorney, Agent, or Firm*—Sughrue, Mion, Zinn, Macpeak & Seas

[57] ABSTRACT

A method of assembling a rotor of a steam turbine constituted by disks (2) shrunk onto a shaft, the disks (2) being provided with cavities (4) facing one another and having female pegs (5) disposed in the cavities in one disk (2) and male pegs (6) disposed in the facing cavities (4) of an adjacent disk (2) with each of the disks (2) being shrunk on while disposing the male pegs (6) of the disks into the female pegs (5) of the already shrunk-on adjacent disk, the method being characterized in that spacers (12) are provided in the female pegs (5) prior to inserting the male pegs (6) in the female pegs (5) so that the male pegs (6) do not come into contact with the female pegs (5), with the spacers (12) subsequently being removed.

2 Claims, 3 Drawing Sheets

METHOD OF ASSEMBLING A ROTOR OF A STEAM TURBINE CONSTTUTED BY DISKS SHRUNK ONTO A SHAFT

The present invention relates to a method of assembling a rotor of a steam turbine constituted by disks shrunk onto a shaft.

BACKGROUND OF THE INVENTION

It is common practice to assemble the rotor of a steam turbine by shrinking disks onto a shaft, said disks being provided with cavities facing one another and having female pegs disposed in said cavities in one disk and male pegs disposed in the facing cavities of an adjacent disk with each of the disks being shrunk on while disposing the male pegs of said disks into the female pegs of the already shrunk-on adjacent disk.

The pegs ensure that these disks are properly positioned relative to one another.

The inventor has observed that when the male pegs are in contact with the female pegs there is a risk of stress corrosion, and an object of the present invention is to reduce this risk and eliminate it where possible.

SUMMARY OF THE INVENTION

In the assembly method according to the invention, spacer means are provided in the female pegs prior to inserting the male pegs in the female pegs so that the male pegs do not come into contact with the female pegs, with the spacer means subsequently being removed.

Preferably, the spacer means are not removed until after overspeed testing, thus making it possible to ensure that there remains residual clearance between the positioning pegs during normal operation.

The invention also relates to a fork for use in the method and in conjunction with a male peg comprising a tenon having two walls parallel to the axis of the rotor and at a spacing a, and a female peg having a complementary slot with two walls parallel to the walls of the tenon and at a spacing of a+2d, wherein the fork comprises a handle and two tines of thickness slightly less than d, with the outside edges being at a spacing of a+2d, and which are capable of being disposed against the walls of the slot.

In a preferred embodiment of the fork in accordance with the invention, each of the two tines includes a flange in a plane perpendicular to the plane of the tines and placed against the surface of the female peg on either side of the slot.

BRIEF DESCRIPTION OF THE DRAWINGS

An embodiment of the invention is described by way of example with reference to the accompanying drawings, in which.

MORE DETAILED DESCRIPTION

The turbine rotor to which the invention is applied comprises a shaft 1 onto which disks 2 bearing blades 3 are shrunk.

Figure 1:
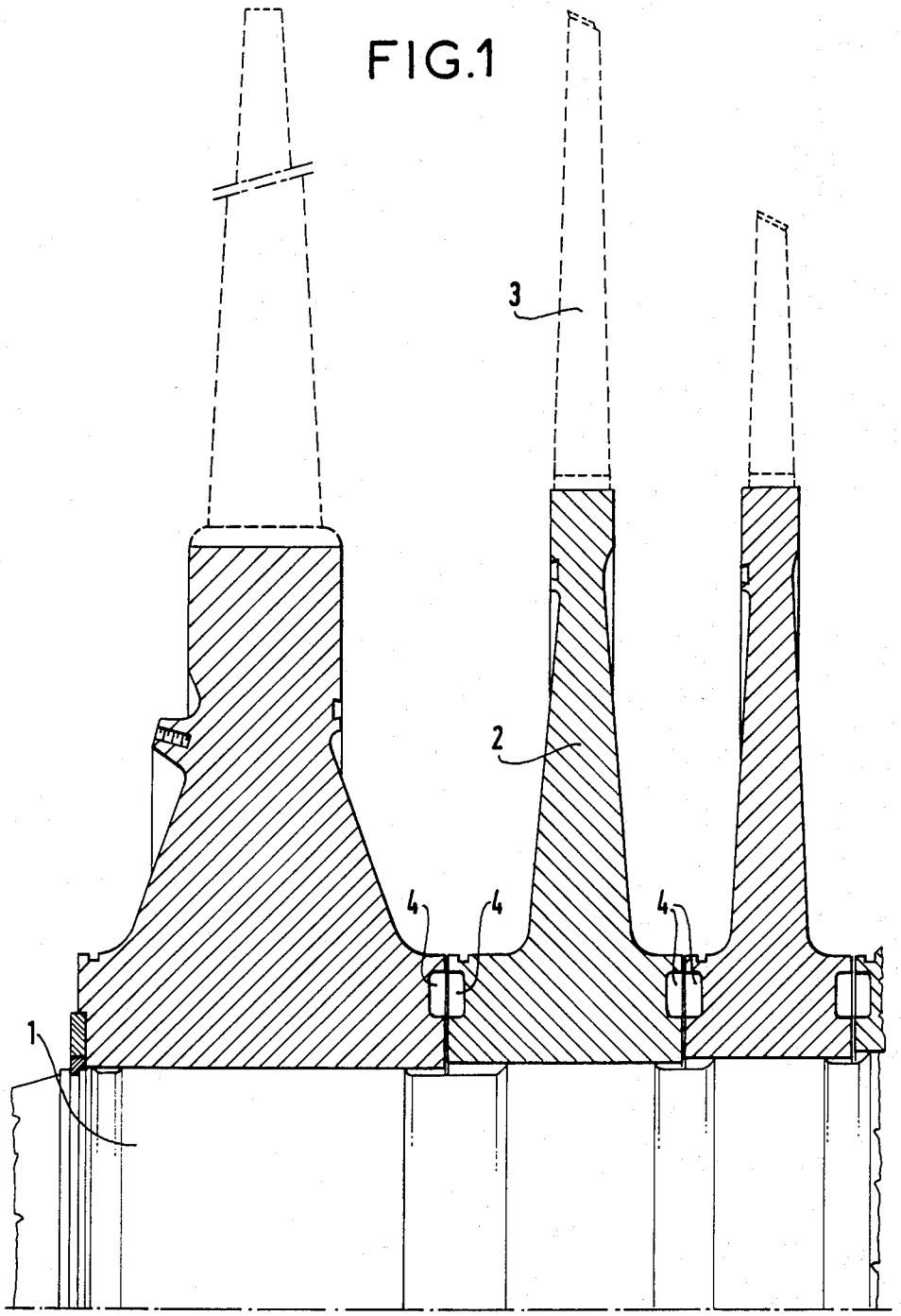
FIG. 1 is a fragmentary longitudinal section through a turbine rotor.
Figure 2:
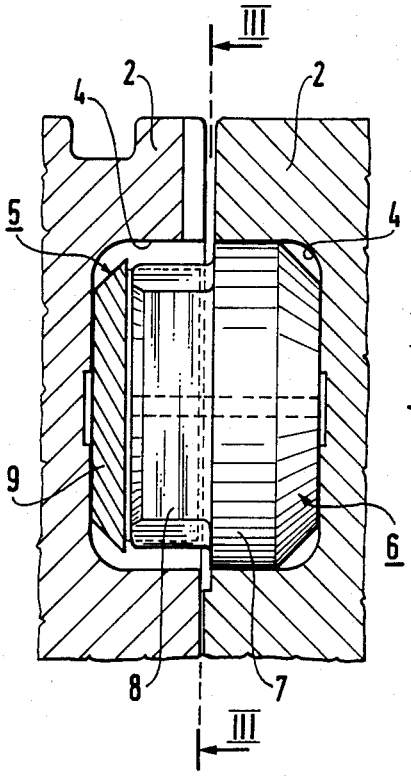
FIG. 2 is a fragmentary section view of interfitting pegs.
Figure 3:
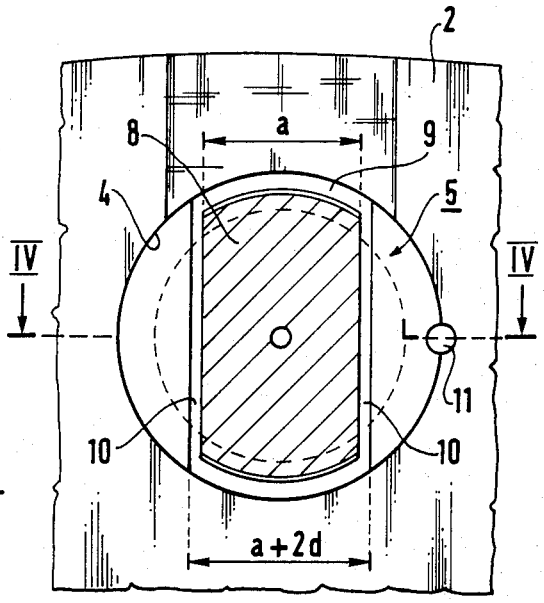
FIG. 3 is a section view of III—III of FIG. 2.
Figure 4:
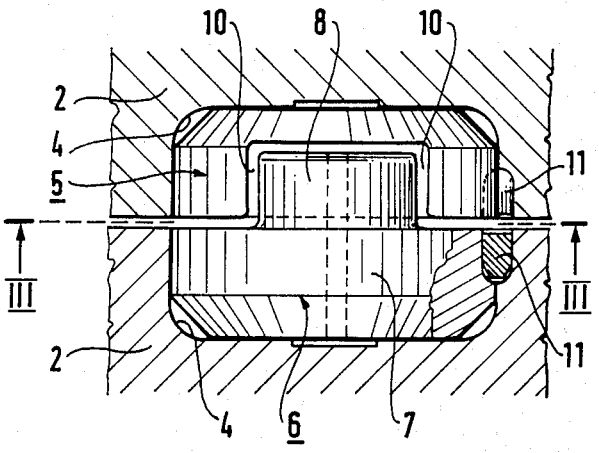
FIG. 4 is a fragmentary section on IV—IV of FIG. 3.
Figure 5:
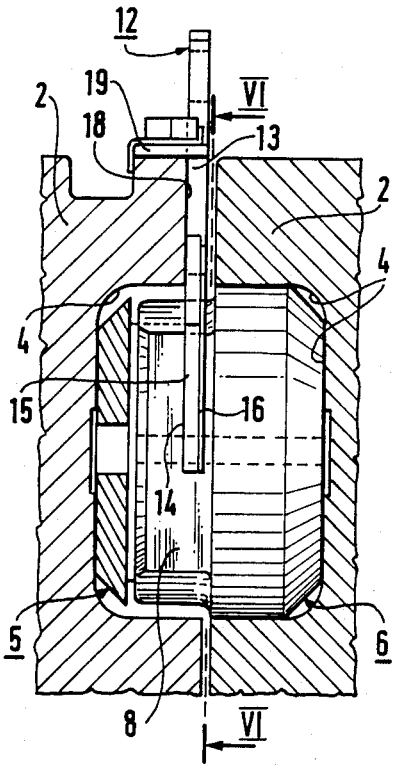
FIG. 5 shows the FIG. 2 assembly with the fork in place.
Figure 6:
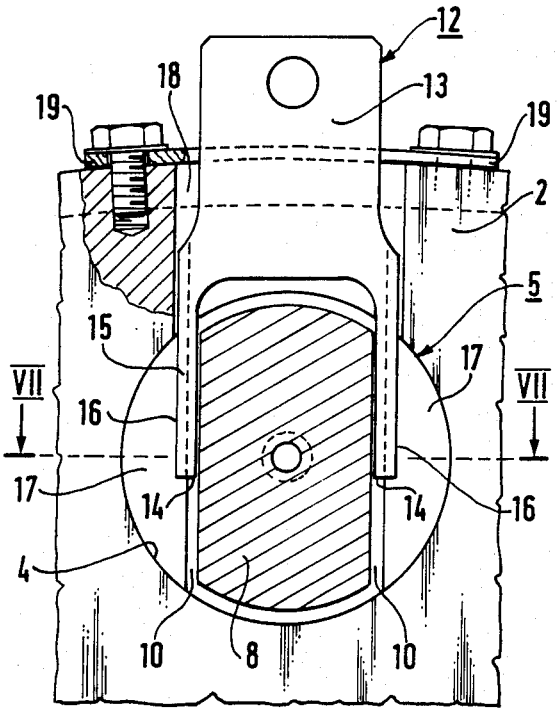
FIG. 6 is a partially cut-away section on VI—VI of FIG. 5.
Figure 7:
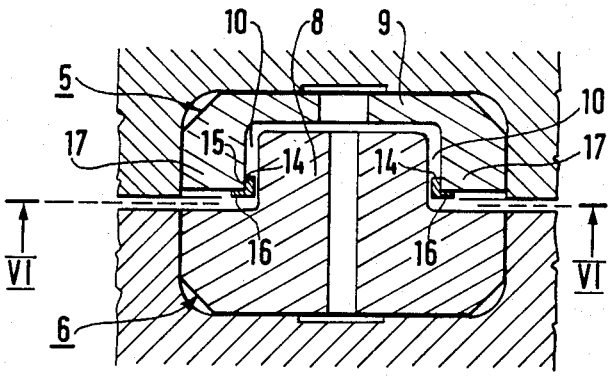
FIG. 7 is a section on VII—VII of FIG. 6.

The disks 2 are provided with facing cylindrical cavities 4. The cavities 4 on one face of a disk are provided with female pegs 5 and the cavities on the face of the adjacent disk which face the female pegs 5 are provided with male pegs 6 (see FIGS. 2, 3, and 4).

A male peg 6 comprises a head 7 filling its cavity 4, and a tenon 8 having two walls parallel to the axis of the rotor and spaced apart at a distance a. A female peg comprises, inside a head 9, a slot 10 which is complementary to the tenon 8 but of width a+2d. the length of the tenon 8 is less than the depth of the slot 10.

The pegs 5 and 6 are held in the cavities 4 by pins 11.

The disks are conventionally mounted as follows.

A first disk 2 is shrunk onto the shaft and its cavities 4 are provided with female pegs 5. A second disk 2 is placed around the shaft with its face facing the cavities 4 being provided with male pegs 6. The tenons 8 of the male pegs 6 are engaged in the slots 10 of the female pegs 5, and then the second disk 2 is shrunk on, and so on for the following disks.

According to the invention, a fork provided with a handle 13 and two tines 14 is used for each assembly between two pegs 5 and 6. The two tines 14 are of thickness less than d and their outer edges 15 are at a spacing of a+2d.

These tines 14 are provided with two outwardly directed flanges 16 which bear on either side of the slot 10 against the surface 17 of the female peg 5 when the tines are disposed in the slot.

The flanges 16 are at right angles to the tines 14.

The disks 2 are provided with notches 18 on their faces which receive the female pegs 5. These notches 18 connect the outside surfaces of the disks 2 to the cavities 4. A fork 12 is disposed in each notch 18. The handle 13 of each fork 12 is fixed to lugs 19 which are bolted to the disks 2, thereby holding the forks 12 in place.

The forks 12 are mounted on the disks 2 prior to the disks being shrunk on.

After being shrunk on, the male pegs 6 of the adjacent disk are fitted in the female pegs 5 of the shrunk-on disk. By virtue of the forks 12, the tenons 8 of the male pegs 6 do not come into contact with the slots 10 of the female pegs 5.

This ensures that the male pegs 6 do not come into contact with the female pegs 5. While overspeed testing is being performed, the forks 12 are kept in place so that the absence of contact is maintained. After testing, the forks 12 are removed in order to enable the turbine to operate normally.

I claim:

1. A method of assembling a rotor of a steam turbine constituted by disks shrunk onto a shaft, said disks being provided with cavities facing one another and having female pegs disposed in said cavities in one disk and male pegs disposed in the facing cavities of an adjacent disk with each of the disks being shrunk on while disposing the male pegs of said disks into the female pegs of the already shrunk-on adjacent disk, wherein spacer means are provided in the female pegs prior to inserting the male pegs in the female pegs so that the male pegs do not come into contact with the female pegs, with the spacer means subsequently being removed.

2. An assembly method according to claim 1, wherein the spacer means are not removed until after overspeed testing.

* * * * *